United States Patent [19]

Dittmer

[11] Patent Number: 5,062,247

[45] Date of Patent: Nov. 5, 1991

[54] VENTILATED MULTIPLE PANE SKYLIGHT

[76] Inventor: Marlan A. Dittmer, 2000 Woodland Boulevard, Fort Myers, Fla. 33907

[21] Appl. No.: 504,120

[22] Filed: Apr. 2, 1990

[51] Int. Cl.[5] ..... E04B 7/18

[52] U.S. Cl. ..... 52/200; 52/302

[58] Field of Search ..... 52/200, 302, 303

[56] References Cited

U.S. PATENT DOCUMENTS

| | | | |
|---|---|---|---|
| 4,197,682 | 4/1980 | Schiff et al. | 52/200 X |
| 4,589,239 | 5/1986 | Cummings | 52/200 |
| 4,930,274 | 6/1990 | Cummings et al. | 52/200 |

*Primary Examiner*—Richard E. Chilcot, Jr.
*Attorney, Agent, or Firm*—William E. Noonan

[57] ABSTRACT

A ventilated, multiple pane skylight is disclosed including a base portion that is mounted to a building for generally surrounding a rooftop opening therein. There is an upper portion that is supported by the base portion and includes inner and outer radiation attenuating panels. The panels are held apart such that an interstitial space is provided between them. An air inlet and outlet is provided through the upper portion so that the interstitial space is ventilated.

13 Claims, 1 Drawing Sheet

VENTILATED MULTIPLE PANE SKYLIGHT

FIELD OF THE INVENTION

This invention relates to a ventilated multiple pane skylight for reducing the transmission of heat, glare and ultraviolet radiation through a rooftop skylight opening.

BACKGROUND OF INVENTION

Rooftop skylights can contribute greatly to the brightness and decor of a house. However, they also tend to cause a number of problems. At times, particularly when the sun is overhead, conventional skylights transmit undesirably large amounts of heat, glare and ultraviolet rays. The heat generated by the skylight may be welcomed during the winter months. However, during the summer months and in Sun Belt locations, this extra heat can add considerably to air conditioning costs. The transmitted ultraviolet rays can contribute to premature fading and deterioration of upholstery and carpeting. The glare that is encountered through the skylight can also be quite annoying.

Various multi-panel skylights have been disclosed. Typically, they provide a layer of insulating air that is built into the skylight, between the panes. To date, however, such products have not satisfactorily addressed the concerns described above. In particular, conventional multiple pane skylights are not adequately ventilated. As a result, the layer of air that is enclosed between the panes becomes quite hot and this heat is transmitted through the interior pane into the building. As a result, the problem of excessive interior heating, particularly in warm climates where skylights are widely used, becomes even worse.

SUMMARY OF THE INVENTION

Therefore, it is an object of this invention to provide a ventilated multiple pane skylight that significantly reduces the heat, glare and ultraviolet rays that are transmitted through the skylight opening.

It is a further object of this invention to provide a multiple pane skylight that allows for effective ventilation of the interstitial space between the panes so that heat transmission through the skylight is significantly reduced.

It is a further object of this invention to provide a skylight that contributes to energy savings and reduces fading of upholstery and carpeting.

It is a further object of this invention to provide a skylight that is easy and inexpensive to install and is ornamentally attractive.

It is a further object of this invention to provide a skylight which accomplishes the above advantages without hindering the view through the skylight from inside the building.

This invention features a ventilated, multiple pane skylight which includes a base portion for mounting on a building to generally peripherally surround a rooftop opening therein. There is an upper portion supported by the base portion. The upper portion includes inner and outer radiation attenuating members. Means are provided for holding the members spaced apart to form an interstitial space therebetween. Air inlet and outlet means are formed through the upper portion in communication with the interstitial space for allowing ventilation through the space.

In a preferred embodiment, the base includes an exterior support section which engages the rooftop and surrounds the rooftop opening. The base may also include an interior support section which is received by the rooftop opening and extends outwardly above the opening.

The radiation attenuating members preferably include light transmitting panels. The means for holding may include first means mounted on the base for retaining the inner panel generally about the peripheral edge thereof. Second retaining means may be spaced generally above the first retaining means for retaining the outer panel above the lower panel. Means may be provided for interconnecting the first and second retaining means. The second retaining means may be spaced peripherally outwardly from the first retaining means. The means for interconnecting may include an interior frame portion that is supported by the base for carrying the first retaining means and an exterior frame portion that is interconnected to and extends above the interior frame portion for carrying the second retaining means above the first retaining means. The inlet and outlet means are preferably formed between the interior frame portion and the exterior frame portion.

The panels are typically spaced from one to two inches apart. The outer panel may include a transparent member and glare attenuating film applied to at least one side of that member. The inner panel may include a transparent member and heat attenuating film applied to at least one side of the member.

DISCLOSURE OF A PREFERRED EMBODIMENT

Other objects, features and advantages will occur from the following description of a preferred embodiment and the accompanying drawings, in which.

Figure 1:
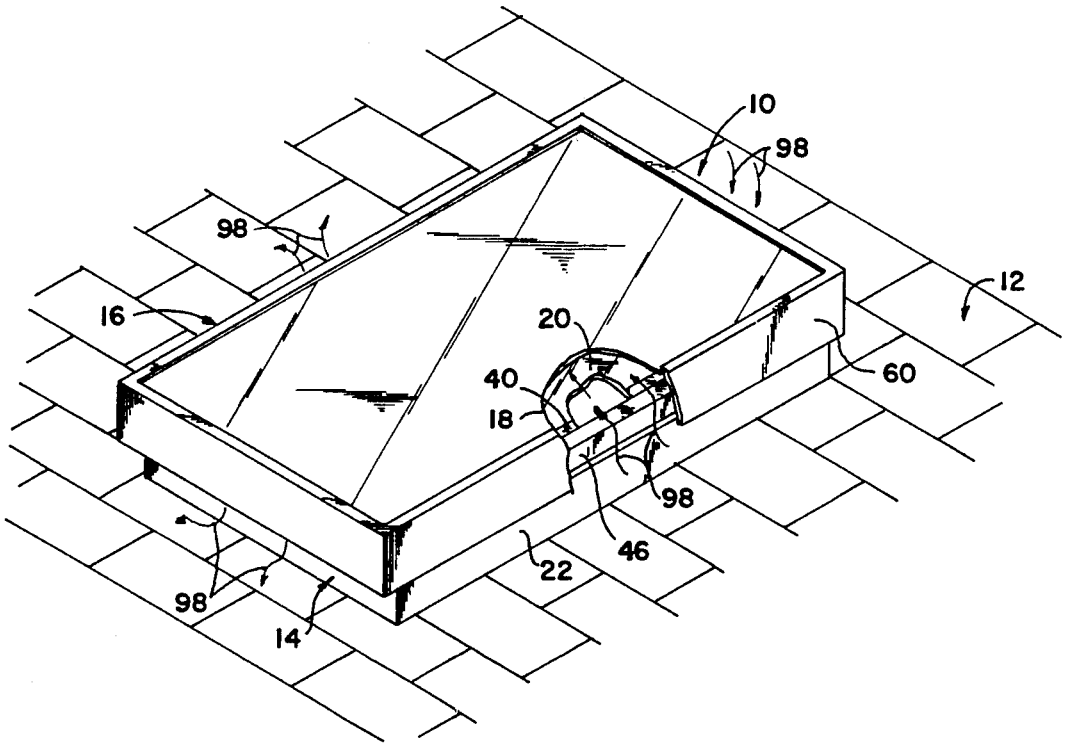
FIG. 1 is an isometric partially cut-away view of a preferred ventilated, multiple pane skylight according to this invention.

A ventilated, multiple pane skylight, according to this invention, is typically constructed by employing a base portion to support an upper portion above a rooftop skylight opening. The base portion is preferably constructed of wood, various plastics, such as PVC, or a combination thereof. The base portion should be of sturdy construction and is mounted to the rooftop about the rooftop opening. The base portion typically includes an interior support section, composed of PVC, which includes a lower end that is received in the rooftop opening and is seated on the end of a piece of sheet rock mounted within the opening. An exterior support section is mounted to the roof and generally surrounds the interior support section. The exterior support section may comprise a plurality of 2" by 4" pieces forming a curb that generally surrounds the rooftop opening.

The upper portion of the skylight accommodates a plurality of radiation attenuating panels. In particular, the upper portion includes a frame that is composed of aluminum, bronze, plastic or similar material. The frame is supported by the base portion. More specifically, the frame includes a first retaining member which generally peripherally engages and holds an inner radiation attenuating panel. This first retaining member is interconnected by an interior frame portion and an exterior frame portion to a second retaining member that generally peripherally holds an outer panel spaced apart from and above the inner panel. As a result, an interstitial space is formed between the panels. Typically, the outer panel is larger than the inner panel and the second retaining member is spaced generally outwardly of the inner retaining member. Air inlet and outlet means are formed through the bottom of the upper portion and, more particularly, between the interior and exterior frame portions so that ventilating air can pass freely through the interstitial space.

The radiation attenuating panels which are utilized in this device typically comprise transparent panels to which radiation attenuating film is applied, although this invention is not limited to the use of such film. As used herein, "radiation attenuating" should be understood to refer to any member which is designed for partially or fully blocking one or more of the glare, heat (infrared radiation) and ultraviolet radiation from the sun to a greater extent than is accomplished by conventional, untreated glass. The panel may be constructed of, for example, ¼" clear laminated safety glass or tempered glass. The outer panel typically includes a tinted film, such as low "E" solar controlled film for substantially reducing the glare through the skylight. The inner panel's film may comprise a low "E" film, such as a silver or other metallized type of film which significantly reduces the heat through the skylight. Preferably, a metallized film is used on the interior panel but it is sufficiently light transmissive so that the view through the skylight is not obscured. Various other tinting, sun blocking processes and compositions may also be employed. Alternatively, non-film radiation restrictive panels, such as solar cooled glass, may be used. In any case, this material should be capable of withstanding a wide variety of weather extremes and should be long lasting. And the radiation attenuating material should be light transmissive so that an unobstructed view is provided for the skylight. Although the embodiments described herein comprise double pane skylights, additional panes may be added within the scope of this invention.

A skylight constructed in the above manner has been determined to eliminate at least 20% of the glare that is otherwise transmitted through the skylight. Additionally, at least 90% of the heat transmitted through the skylight is eliminated. This significantly lowers air conditioning expenses. A significant portion of this heat is eliminated through the ventilation that is provided through the interstitial space via the air inlet and outlet means. Furthermore, 100% of the ultraviolet rays are blocks so that fading of upholstery and carpeting is significantly reduced.

There is shown in FIG. 1 a multiple pane skylight 10 that is mounted above an opening in a rooftop 12. Skylight 10 exhibits a rectangular shape, although in alternative embodiments various other shapes may be utilized. The skylight includes a base portion 14 that is mounted to rooftop 12 in such a way that it generally surrounds the opening in the roof. An upper portion 16 shown in a plan view in FIG. 2, includes a pair of radiation attenuating panels 18 and 20, which are described more fully below.

Figure 3:
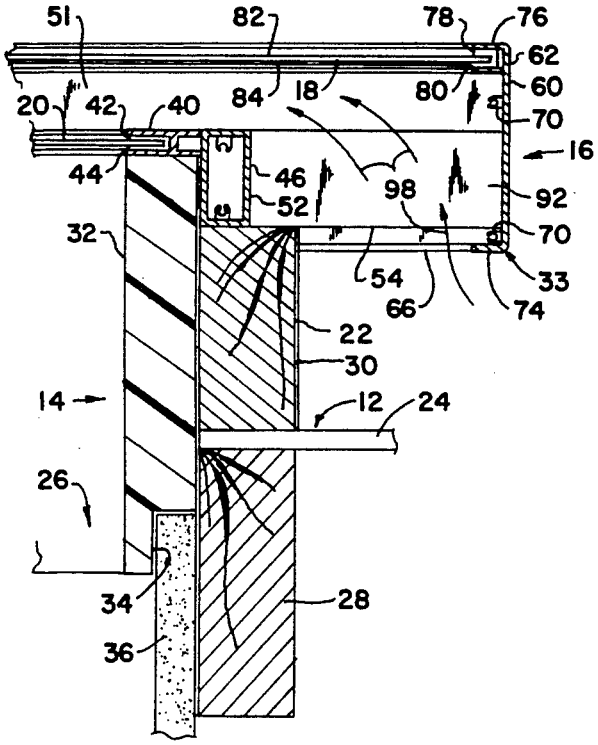
FIG. 3 is a cross sectional view taken along line 3—3 of FIG. 2.

As best shown in FIG. 3, base portion 14 includes an exterior support section 22 which is mounted above roof sheeting 24. Section 22 typically comprises a plurality of (typically four) 2" by 4" segments which extend generally peripherally about the rooftop opening 26. One such segment is shown in FIG. 3. Each segment is disposed along a respective side of opening 26. Typically, a rafter 28 extends below each segment of section 22 inside of the roof sheeting 24. The section 22 is secured to the rooftop by conventional means such as nails or screws. Aluminum flashing 30 is formed along the exterior surface of support section 22.

An interior support section 32 is mounted inside of rooftop opening 26. More particularly, section 32 includes four segments which engage respective sides of opening 26. Again, one segment of section 32 is depicted in FIG. 3. Each such segment includes a notch 34 that is formed in its lower end so that the segment fits against and is seated on the upper end of a respective piece of sheet rock 36 which extends along the wall of opening 26 to a point just below the roof line. Support section 32 may be nailed to various other elements such as the outer support section 22 and/or the rafter 28. The upper end of section 32 extends out of opening 26 to a point above the roof line 12. Section 32 is formed in this manner about the entire periphery of opening 26.

Upper portion 16 includes means such as a frame 33 for holding inner panel 20 and outer panel 18 in a generally parallel, spaced apart relationship so that an interstitial air space 51 is formed between the panels. More particularly, an H-shaped first retaining member 40 is mounted to the top surface of support section 32. Member 40 may be secured to section 32 by conventional means such as adhesive, nails, rivets or screws. Retaining member 40 includes an inwardly directed channel 42 that receives the peripheral edge of inner panel 20. An elastomeric gasket 44 formed of rubber, vinyl or similar material, provides a snug fit between the panel 20 and the retaining member 42 so that panel 20 is held securely in place by the retaining member. As best exhibited in FIG. 2, the retaining member 40 surrounds inner panel 20 so that generally the entire peripheral edge of the panel is held in place in this manner.

Figure 2:
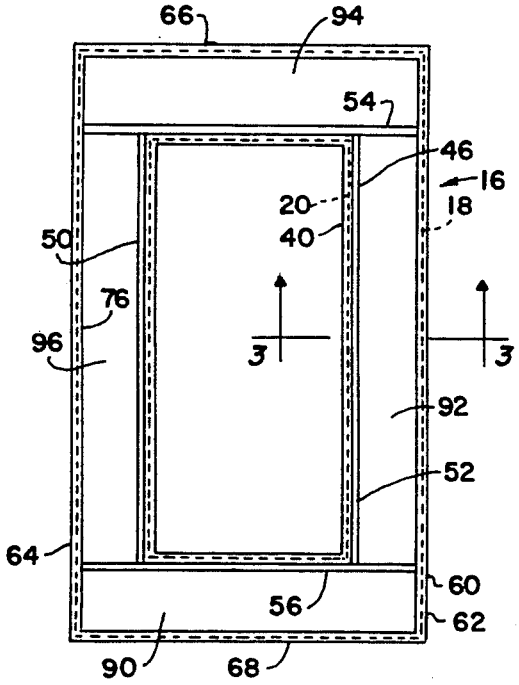
FIG. 2 is a plan view of the skylight.

An interior frame portion 46, FIGS. 2 and 3, is disposed peripherally about retaining member 40. Frame 46 includes four elongate elements 50, 52, 54 and 56 comprising bronze tubes or similar means. These elements are arranged in a rectangular manner about retaining member 40. As best shown in FIG. 3, the upper surface of frame 46 is generally flush with the upper surface of the retaining member 40. The frame 46 itself may be secured to the upper surface of base support section 22 by bolts or other attachment means. The elongate elements 50 and 52 that form the long side of rectangular frame 46 are attached at their respective ends by appropriate attachment means, such as bolts or welding, to elongate elements 54 and 56, which form the short sides of the frame. The ends of elements 54 and 56 extend outwardly of the elements 50 and 52. These ends are connected to an exterior frame portion 60, which extends about the entire periphery of skylight 10. Frame 60 is typically composed of bronze, aluminum, wood, vinyl or alternative materials. Again, exterior frame 60 is made up of four elongate elements 62, 64, 66 and 68 which are secured together by screws which are fit into conventional screw jackets 70 or by other suitable connector means.

As best shown in FIG. 3, the lower edge of each exterior frame element is bent at a generally 90 degree angle inwardly at 74 toward the base portion. Along its upper edge, frame 60 carries a second retaining member 76, FIGS. 2 and 3, that includes a channel 78 which faces inwardly of the skylight. The retaining member is typically formed integrally with the exterior frame portion 60. The outer peripheral edge of the upper panel 18 is held within channel 78. A rubber or other elastomeric gasket 80 holds panel 18 snugly in place. As with retaining member 40, retaining member 76 extends fully about frame 60.

Panel 18 typically comprises a piece of tempered glass 82 which is ¼" thick. A low "E" solar controlled film or similar radiation attenuating element 84 is secured to the inner surface of panel 18. Preferably this film is tinted so that glare is reduced. Such material can also help to block at least a portion of the infrared and 100 percent of the ultraviolet rays. The inner panel 20 likewise includes a piece of tempered glass to which an appropriate radiation attenuating film is applied. For the inner panel 18, a primarily heat attenuating film is preferred, rather than a glare reducing film.

As best shown in FIG. 3, the bottom peripheral region of upper portion 16 is generally open so that an air inlet and outlet is provided to interstitial space 51. More particularly, as shown in FIG. 2, a plurality of openings 90, 92, 94 and 96 are formed generally between the outer frame portion 60 and the inner frame portion 46. Only opening 92 is illustrated in FIG. 3. These openings are in communication with interstitial space 51 so that ventilation, represented in FIGS. 1 and 3 by arrows 98, is provided through upper portion 60 and through space 51. This keeps the space 51 relatively cool. As the space is heated by sun passing through upper panel 18, that heated air is cooled by the fresh air flow 98 passing through the space 51. Inner panel 20 further reduces the infrared radiation and heat generated by the sunlight. As a result, over 90% of the heat which would otherwise be generated by the skylight is prevented from entering the building. Energy savings and a much more efficient skylight are therefore provided.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A ventilated, multiple pane skylight comprising:

a base portion for mounting on a building to generally peripherally surround a rooftop opening therein; and an upper portion supported by said base portion, above the rooftop opening, said upper portion including inner and outer radiation attenuating members, means for holding said members spaced apart to form an interstitial space therebetween, and air inlet and outlet means formed through said upper portion above the rooftop opening in communication with said interstitial space for allowing outside air to ventilate said space.

2. The device of claim 1 in which said base includes an exterior support section which engages the rooftop and surrounds said rooftop opening.

3. The device of claim 1 in which said base includes an interior support section which is received by said rooftop opening and extends outwardly above said opening.

4. The device of claim 1 in which said means for holding includes a first means mounted on said base for retaining said inner member generally about the peripheral edge thereof, second retaining means, spaced generally above said first retaining means, for retaining said outer member above said inner member and means for interconnecting said first and second retaining means.

5. The device of claim 4 in which said second retaining means is spaced peripherally outwardly from said first retaining means.

6. The device of claim 4 in which said means for interconnecting include an interior frame portion supported by said base for carrying said first retaining means and an exterior frame portion interconnected to spaced peripherally outwardly from, and extending above said interior frame portion for carrying said second retaining means above said first retaining means.

7. The device of claim 6 in which said air inlet and outlet means are formed between said interior frame portion and said exterior frame portion.

8. The device of claim 1 in which said inner and outer members are spaced from one to two inches apart.

9. The device of claim 1 in which said outer member includes a transparent element and glare attenuating film applied to at least one side of said element.

10. The device of claim 1 in which said inner member includes a transparent element and heat attenuating film applied to at least one side of said member.

11. The device of claim 1 in which said inner and outer members include light transmitting panels.

12. The device of claim 6 in which said air inlet and outlet means are formed in a bottom of said upper portion between said interior frame portion and said exterior frame portion and facing in a generally downward direction toward the rooftop of said building.

13. A ventilated, multiple pane skylight comprising:

a base portion for mounting on a building to generally peripherally surround a rooftop opening therein; and an upper portion supported by said base portion above the rooftop opening, said upper portion including inner and outer radiation attenuating members, means for holding said members spaced apart to form an interstitial space therebetween, and air inlet and outlet means formed through said upper portion above the rooftop opening in communication with said interstitial space for allowing outside air to ventilate said space, said means for holding including a first means mounted on said base for retaining said inner member generally about a peripheral edge thereof, second retaining means spaced generally above said first retaining means for retaining said outer member above said inner member and means for interconnecting said first and second retaining means, said means for interconnecting including an interior frame portion supported by said base for carrying said first retaining means and an exterior frame portion interconnected to, spaced peripherally outwardly from and extending above said interior frame portion for carrying said second retaining means above said first retaining means, said air inlet and outlet means being formed in a bottom of said upper portion between said interior frame portion and said exterior frame portion and facing in a generally downward direction toward the rooftop of the building.

* * * * *